US012025119B2

(12) United States Patent
Snels

(10) Patent No.: US 12,025,119 B2
(45) Date of Patent: Jul. 2, 2024

(54) METHOD FOR ACTUATING A COMPRESSOR SYSTEM AND A COMPRESSOR SYSTEM

(71) Applicant: ATLAS COPCO AIRPOWER, NAAMLOZE VENNOOTSCHAP, Wilrijk (BE)

(72) Inventor: Guy L. A. Snels, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 277 days.

(21) Appl. No.: 16/961,703

(22) PCT Filed: Feb. 21, 2019

(86) PCT No.: PCT/IB2019/051421
§ 371 (c)(1),
(2) Date: Jul. 13, 2020

(87) PCT Pub. No.: WO2019/162872
PCT Pub. Date: Aug. 29, 2019

(65) Prior Publication Data

US 2021/0054836 A1 Feb. 25, 2021

(30) Foreign Application Priority Data

Feb. 23, 2018 (BE) ..... 2018/5112

(51) Int. Cl.
*F04B 49/22* (2006.01)
*F04B 49/08* (2006.01)
(Continued)

(52) U.S. Cl.
CPC ..... *F04B 49/225* (2013.01); *F04B 49/08* (2013.01); *F04C 28/06* (2013.01); *F04C 28/08* (2013.01);
(Continued)

(58) Field of Classification Search
CPC ..... F04B 49/08; F04B 49/225; F04B 2203/0209; F04B 2205/05; F04B 49/20;
(Continued)

(56) References Cited

U.S. PATENT DOCUMENTS 4,068,980 A * 1/1978 Fine ..... F04C 28/06 417/27
6,146,100 A * 11/2000 Broucke ..... F04C 28/24 417/295
(Continued)

FOREIGN PATENT DOCUMENTS

DE 2717224 A1 10/1978
EP 0952412 A2 10/1999
(Continued)

OTHER PUBLICATIONS

International Search Report and Written Opinion in corresponding PCT Application No. PCT/IB2019/051421, dated May 17, 2019.
(Continued)

*Primary Examiner* — Alexander B Comley
(74) *Attorney, Agent, or Firm* — BACON&THOMAS,PLLC

(57) ABSTRACT

A method for actuating a compressor system in order to set a measured operating pressure, which serves as a measure for the operating pressure that the compressor system supplies to a user network at a flow rate demanded by a user network, to a desired operating pressure. The compressor system includes a compressor element with an inlet and an outlet. The compressor element is driven by a drive. The compressor system is provided with a way for throttling the inlet of the compressor element. As long as an operating pressure p, selected from the measured operating pressure $p_w$ and the desired operating pressure $p_{set}$, is higher than the maximum obtainable operating pressure $p_{w,max}$ for the afore-
(Continued)

mentioned compressor system, the inlet is throttled for at least a specific percentagexgreater than zero.

14 Claims, 2 Drawing Sheets

(51) Int. Cl.
*F04B 49/20* (2006.01)
*F04C 28/06* (2006.01)
*F04C 28/08* (2006.01)

(52) U.S. Cl.
CPC ..... *F04B 49/20* (2013.01); *F04B 2203/0209* (2013.01); *F04B 2205/05* (2013.01)

(58) Field of Classification Search
CPC .... F04C 18/14–18; F04C 28/06; F04C 28/08; F04C 28/24
USPC ..... 417/295
See application file for complete search history.

(56) References Cited

U.S. PATENT DOCUMENTS

2007/0172370 A1* 7/2007 Takano ..... F04C 28/24 418/13
2007/0189905 A1* 8/2007 Dinsdale ..... F04D 17/12 417/2
2008/0014097 A1* 1/2008 Hase ..... F04B 49/065 417/212
2013/0039741 A1* 2/2013 Yoda ..... F04B 15/02 415/49
2014/0316672 A1* 10/2014 Uhrich ..... F02P 5/045 123/406.13
2016/0215777 A1* 7/2016 De Schamphelaere ..... F04C 29/0014

FOREIGN PATENT DOCUMENTS

EP 1016787 A2 7/2000
EP 1134422 A2 9/2001
GB 686547 1/1953
JP 2006283649 A * 10/2006
WO 2016041026 A1 3/2016
WO WO-2016041026 A1 * 3/2016 ..... F04C 18/16

OTHER PUBLICATIONS

Written Opinion of International Preliminary Examining Authority in corresponding PCT Application No. PCT/IB2019/051421, dated Feb. 3, 2020.
International Preliminary Report on Patentability in corresponding PCT Application No. PCT/IB2019/051421, dated Jun. 18, 2020.

* cited by examiner

METHOD FOR ACTUATING A COMPRESSOR SYSTEM AND A COMPRESSOR SYSTEM

The present invention relates to a method for actuating a compressor system.

More specifically, the invention is meant to increase the maximum operating pressure of a compressor system.

For these purposes, operating pressure means the pressure supplied by the compressor system to a consumer network.

BACKGROUND OF THE INVENTION

Traditionally, a compressor system is actuated such that it will supply a flow rate demanded by the consumer network at a desired operating pressure.

When the consumer network takes in a higher or lower flow rate, without controlling the flow rate supplied by the compressor system, the operating pressure would drop or increase, respectively, which is obviously undesirable.

In order to set the operating pressure to a desired operating pressure, a compressor element of the compressor system will supply a lower or a higher flow rate.

The flow rate may be controlled by throttling the inlet of the compressor element, for instance by way of an inlet throttling valve, and if the rotational speed of the drive of the compressor system driving the compressor element is variable, by adjusting this rotational speed.

At the moment in which the compressor system must supply a maximum flow rate, the drive is running at its maximum rotational speed, and the inlet throttling valve is entirely open.

In order to set the operating pressure to the desired operating pressure at the moment that the consumer network starts taking in a lower flow rate, the flow rate supplied by the compressor element will have to be reduced.

For these purposes, if the rotational speed of the drive is variable, the rotational speed of the drive is first reduced. At a certain moment, the minimal rotational speed of the drive will be reached. At that moment, the inlet throttling valve will be throttled in order to set the operating pressure to a desired operating pressure as demanded by the consumer network.

By reducing the rotational speed, the consumption of the drive will decrease. By first reducing the rotational speed of the drive and throttling the inlet throttling valve only after the minimal rotational speed of the drive is reached, the efficiency of the compressor system will be at its highest possible, and consumption at its lowest possible.

A compressor system is preferably applicable in the broadest possible field of application, meaning: for the largest possible range of operating pressures and flow rates.

In practice, the power that the drive must deliver will be determined by the flow rate delivered by the compressor element, and by the operating pressure.

The power that the drive can deliver is determined by the rotational speed and is expressed by the rotational speed power curve. Thus, when rotational speeds are lower, the available power is likely to be more limited.

The characteristics of the drive of the compressor system, combined with the transmission to the compressor element, therefore determine the field of application of the compressor system, and therefore the maximum operating pressure that is possible when the previously described known method for setting the operating pressure of the compressor system to the desired operating pressure at a flow rate demanded by the user network of the compressor system is used.

SUMMARY OF THE INVENTION

The objective of the present invention is to increase the field of application of the compressor system, and more specifically, to allow for a realization of a higher operating pressure.

The subject of the present invention is a method for actuating a compressor system in order to set the measured operating pressure $p_w$, which serves as a measure for the operating pressure that the compressor system supplies to a user network at a flow rate Q demanded by that user network, to a desired operating pressure $p_{set}$, the compressor system comprising a compressor element with an inlet and an outlet, and wherein the compressor element is driven by a drive, wherein the compressor system is provided with means to throttle the inlet of the compressor element, with the characteristic that as long as an operating pressure p, selected from the measured operating pressure $p_w$ and the desired operating pressure $p_{set}$, is higher than the without the aforementioned means maximum obtainable operating pressure $p_w$, max for the aforementioned compressor system, the inlet is throttled by the aforementioned means for at least a specific percentagexgreater than zero.

The maximum obtainable operating pressure $p_{w,max}$ for the compressor system without the aforementioned means for throttling the inlet of the compressor element is the maximum operating pressure that can be achieved by way of the traditional known control method of the compressor system, in which the inlet is not throttled for at least a specific percentagexgreater than zero, as described above.

When the operating pressure p, selected from the measured operating pressure $p_w$ and the desired operating pressure $p_{set}$, is equal to or lower than the aforementioned maximum obtainable operating pressure $p_{w,max}$, the method will consist of applying the traditional known control method in order to set the measured operating pressure $p_w$, which serves as a measure for the operating pressure that the compressor system supplies to a user network at a flow rate Q demanded by that user network, to the desired operating pressure $p_{set}$.

When the operating pressure p, selected from the measured operating pressure $p_w$ and the desired operating pressure $p_{set}$, is higher than the aforementioned maximum obtainable operating pressure $p_{w,max}$, the method will consist of throttling the inlet for at least a specific percentagexgreater than zero.

One advantage is that an operating pressure higher than $p_{w,max}$ can now be achieved, just by the compressor system by throttling the inlet for at least a specific percentagexgreater than zero.

After all, this will reduce the flow rate of compressed gas, and therefore also the power absorbed by the compressor element.

As a result, the drive will have a greater surplus power, such that a higher operating pressure can be realized.

By not reducing the rotational speed and throttling an inlet a little bit, a greater surplus power of the drive is generated, i.e. the drive maintains the maximum power, whereas the power absorbed by the compressor element drops.

Depending on the course of the rotational speed power curve, when the operating pressure p is greater than the aforementioned maximum obtainable operating pressure $p_{w,max}$, it may be interesting not to maintain at a maximum the rotational speed, but rather the delivered torque of the drive.

The aforementioned consumer network must be understood very broadly, and it refers to at least one consumer who takes in compressed gas from the compressor system. In most cases, however, the consumer network will consist of multiple consumers of compressed gas, who are connected in a network with the compressor system.

Preferably, the aforementioned specific percentage x, which is the minimum by which the inlet of the compressor element is throttled as long as the operating pressure p is higher than the aforementioned maximum obtainable operating pressure $p_{w,max}$, increases, and preferentially, but not strictly necessary, it increases in proportion with the difference between the operating pressure p and the aforementioned maximum obtainable $p_{w,max}$.

One advantage is that by throttling the inlet to such a degree that the desired operating pressure $p_{set}$ can only just be achieved, and thus refraining from throttling more than strictly necessary, the maximum possible flow rate can always be supplied by the compressor system.

The invention also relates to a compressor system comprising a compressor element with an inlet and an outlet, the compressor element being driven by a drive, wherein the compressor system is provided with means for throttling the inlet of the compressor element, with the characteristic that the compressor system features a control unit capable of actuating the aforementioned means, wherein the control unit is configured to execute the method according to the invention.

The benefits of such a compressor system are obviously similar in nature to the benefits of the method according to the invention.

In a preferred embodiment of the invention, the rotational speed of the drive of the compressor system can be controlled by way of the aforementioned control unit.

BRIEF DESCRIPTION OF THE DRAWINGS

In order to better demonstrate the features of the invention, some preferred embodiments of a method and a compressor system according to the invention will be described below, only by way of example and without any restrictive character, with reference to the accompanying drawings, of which.

DETAILED DESCRIPTION OF THE INVENTION

Figure 1:
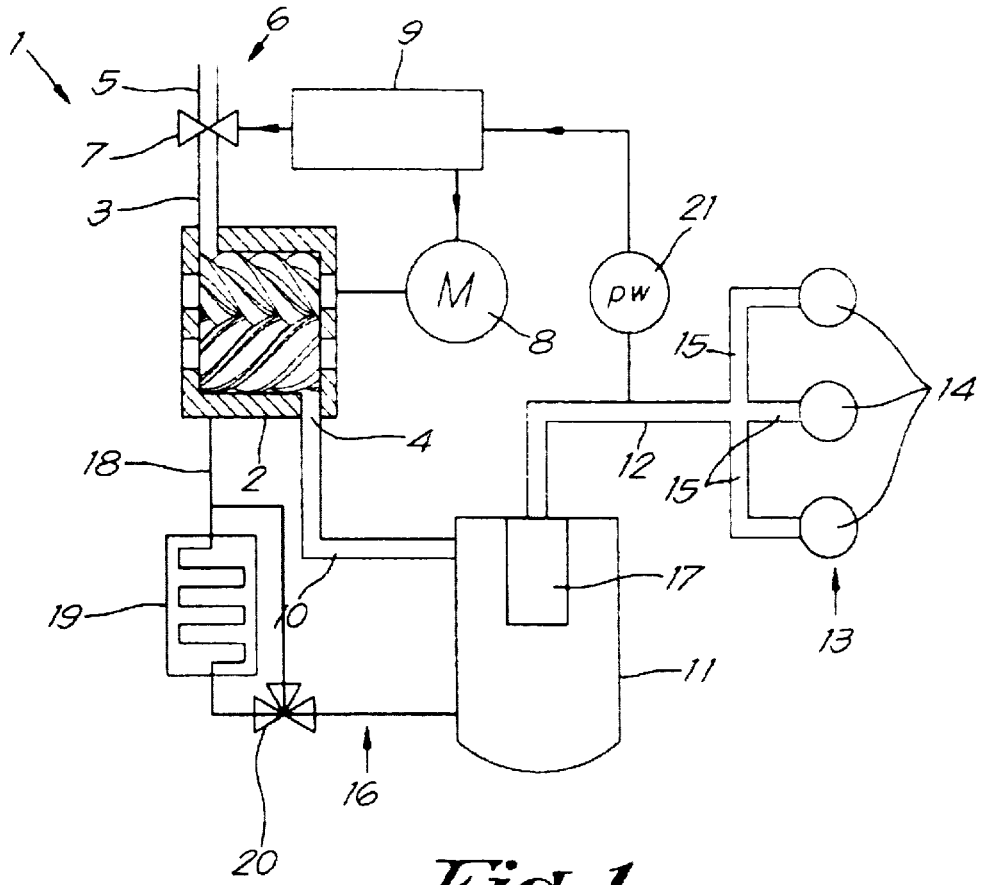
FIG. 1 shows a schematic representation of a compressor system according to the invention.

The compressor system 1 shown in FIG. 1 shown is in this case an oil-injected screw compressor system 1, and in this example it comprises one screw compressor element 2.

The invention does not preclude the provision of more than one screw compressor element 2, meaning that the compressor system 1 is a two- or a multi-stage compression system 1.

Moreover, according to the invention, it is not excluded that the invention does not relate to an oil-injected compressor system 1 and/or not to a screw compressor system 1.

In other words: the invention relates to a whole variety of compressor systems 1.

In this case, though not necessary, it relates to a mobile compressor system 1.

The compressor element 2 is provided with an inlet 3 for sucking in gas to be compressed and an outlet 4 for compressed gas.

The inlet 3 connects to an inlet line 5 wherein means 6 are provided to throttle the inlet 3 of the compressor element, in this case, in the form of an inlet throttling valve 7.

The compressor system 1 is provided with a drive 8 for driving the compressor element 2.

This drive 8 may be a diesel, gas, or petrol engine, but it may also be an electric motor, a permanent magnet motor, a turbine, or something similar.

The means 6 for throttling the inlet 3 and, in case the drive 8 has a variable rotational speed s, the drive 8 are connected with a control unit 9. According to the invention, this control unit 9 is configured to actuate the means 6 and, in case the drive 8 has a variable rotational speed s, to control the rotational speed of the drive 8.

The outlet 4 of the compressor element 2 is in this example connected via an outlet line 10 with a pressure tank 11.

From the pressure tank 11, a pressure line 12 leads to a consumer network 13.

In this case, the consumer network 13 comprises three consumers 14 of compressed gas.

It is clear that the consumer network 13 may take many different forms and may range from a single consumer 14 who is connected directly to the pressure line 12 to a very complex network with dozens of consumers 14 who are connected in parallel and serially in a complex network of lines 15.

Furthermore, in this example, an oil circuit 16 is also provided to enable the injection of oil into the compressor element 2.

For these purposes, an oil separator 17 is placed inside the aforementioned pressure tank 11. It is also referred to as an 'oil separator element'.

Therein, the separated oil is separated from the compressed air and collected at the bottom of the pressure tank 11.

Departing from the pressure tank 11 is an oil line 18 to enable the injection of oil into the compressor element 2 for lubricating and/or cooling the compressor element.

It is not excluded that the oil is also used to lubricate and/or cool the drive 8.

In this oil line 18, a heat exchanger 19 is included to enable cooling of the oil, and a three-way valve 20 to enable at least partly bypassing of the heat exchanger 19. It is clear that this heat exchanger 19 and the three-way valve 20 are not necessary for the invention and may also be placed elsewhere in the compressor system 1 and/or may be carried out in another alternative way.

Finally, the compressor system 1 in this case features a pressure sensor 21 capable of determining or measuring the operating pressure in the pressure tank 11 or in the pressure line 12, thus producing a value for the measured operating pressure $p_w$.

Figure 2:
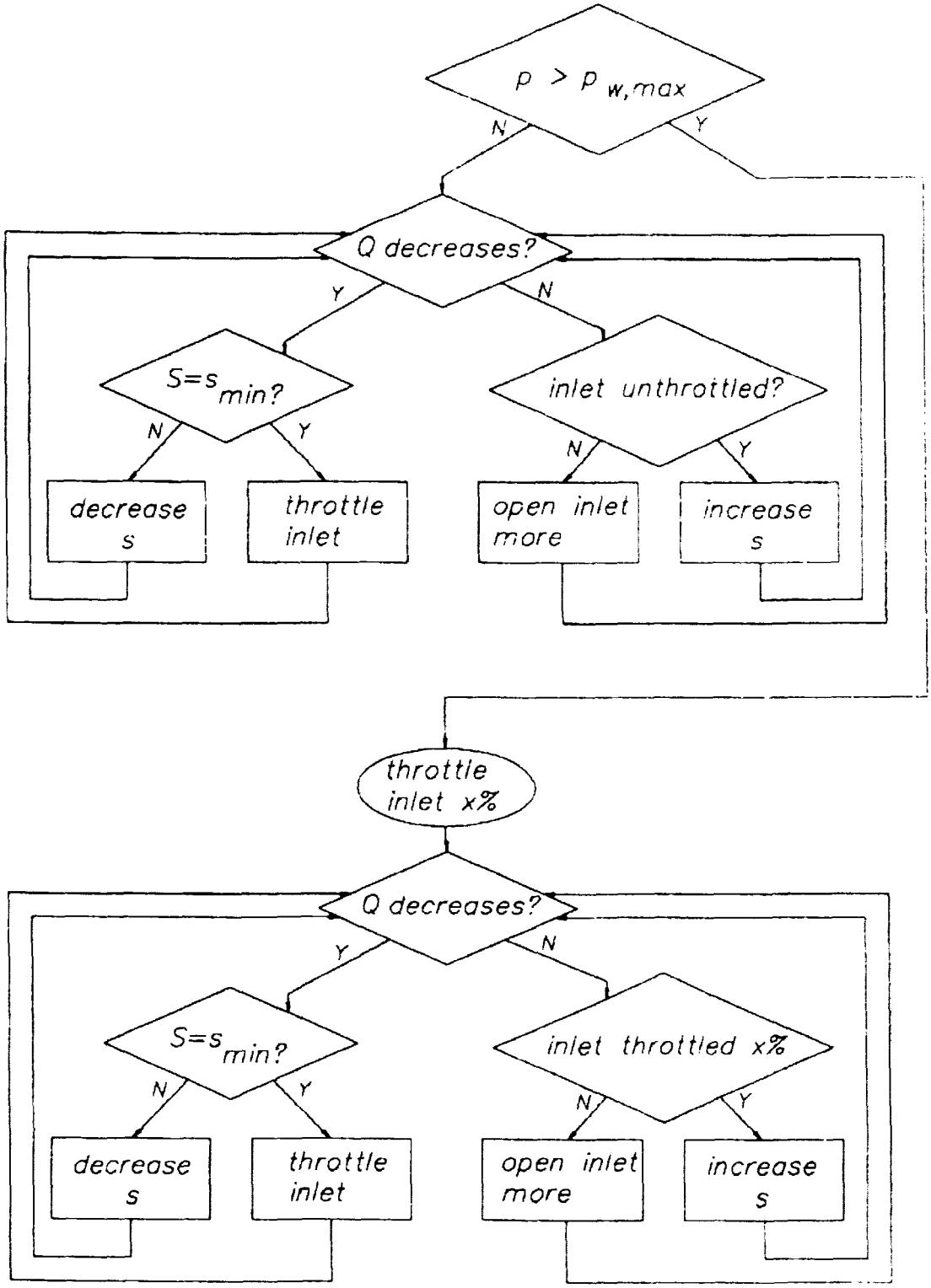
FIG. 2 shows a schematic flow diagram of the method according to the invention.

The actuation of the compressor system 1 according to the method of the invention is very easy and as shown in FIG. 2.

During the operation of the compressor system 1, the compressor element 2 will be driven by the drive 8, and it will compress sucked-in gas.

The compressed gas is supplied via the outlet line 10 and the pressure line 12 to the consumer network 13.

The consumer network 13 requires the supplied compressed gas to have a desired pressure. This pressure is also referred to as the desired operating pressure $p_{set}$.

Depending on the flow rate Q demanded by the consumers 14 in the consumer network 13, the compressor element 2 must supply a higher or lower flow rate in order to set the measured operating pressure $p_w$ to the desired operating pressure $p_{set}$.

For these purposes, the control unit 9 applies the following control method, shown schematically in FIG. 2.

First, it is determined whether an operating pressure p selected from the measured operating pressure $p_w$ and the desired operating pressure $p_{set}$, is lower or higher than the without the means 6 maximum obtainable operating pressure $p_{w,max}$ for the compressor system 1.

The desired operating pressure $p_{set}$ is chosen by the user of the compressor system 1 and may, for example, be entered into the control unit 9 by the user.

The aforementioned maximum obtainable operating pressure $p_{w,max}$ is determined by the maximum operating pressure that the compressor system 1 can supply to the consumer network 13 if the traditional control method for setting the measured operating pressure $p_w$ to the desired operating pressure $p_{set}$ is applied, wherein the inlet 3 is not throttled by the means 6 for at least a specific percentagexgreater than zero.

As long as the operating pressure p is equal to or lower than the aforementioned maximum obtainable operating pressure $p_{w,max}$, the known traditional control method will be applied.

This implies that as long as the demanded flow rate Q drops, first the rotational speed s of the drive 8 is reduced in order to set the measured operating pressure $p_w$ to the desired operating pressure $p_{set}$, and only when the minimum rotational speed $s_{min}$ of the drive 8 is reached and the demanded flow rate Q continues to fall, the inlet 3 is throttled by the means 6 in order to set the measured operating pressure $p_w$ to the desired operating pressure $p_{set}$. If the rotational speed of the drive is not variable, the rotational speed s of the drive 8 is equal to the minimal rotational speed $s_{min}$ already at the beginning of the control, as a result of which the inlet 3 is throttled by the means 6 in order to set the measured operating pressure $p_w$ to the desired operating pressure $p_{set}$ without first reducing the rotational speed s of the drive 8.

The minimal rotational speed $s_{min}$ of the drive 8 is preferably determined by various conditions. A first condition is that the drive 8 must be able to supply sufficient power and torque to avoid a stoppage of the drive 8. Furthermore, the rotational speed s must be sufficiently removed, for instance by a factor 1.4, from the critical rotational speed of the coupling between the drive and the compressor element, wherein the coupling fails due to excessive heating.

As long as the operating pressure p is higher than the aforementioned maximum obtainable operating pressure $p_{w,max}$, the following control method is applied:

- the inlet 3 is throttled for a specific percentagexgreater than zero;
- as long as the demanded flow rate Q drops, first, if possible, the rotational speed s of the drive 8 is reduced in order to set the measured operating pressure $p_w$ to the desired operating pressure $p_{set}$ until a minimum rotational speed $s_{min}$ of the drive is reached;
- when the minimum rotational speed $s_{min}$ of the drive 8 is reached, and as long as the demanded flow rate Q drops further, the inlet 3 is throttled further in order to set the measured operating pressure $p_w$ to the desired operating pressure $p_{set}$.

The specific percentagexgreater than zero by which the inlet 3 of the compressor element 2 is throttled at least increases, preferably proportionally, with the difference between the operating pressure p and the aforementioned maximum obtainable operating pressure $p_w$, max.

Figure 3:
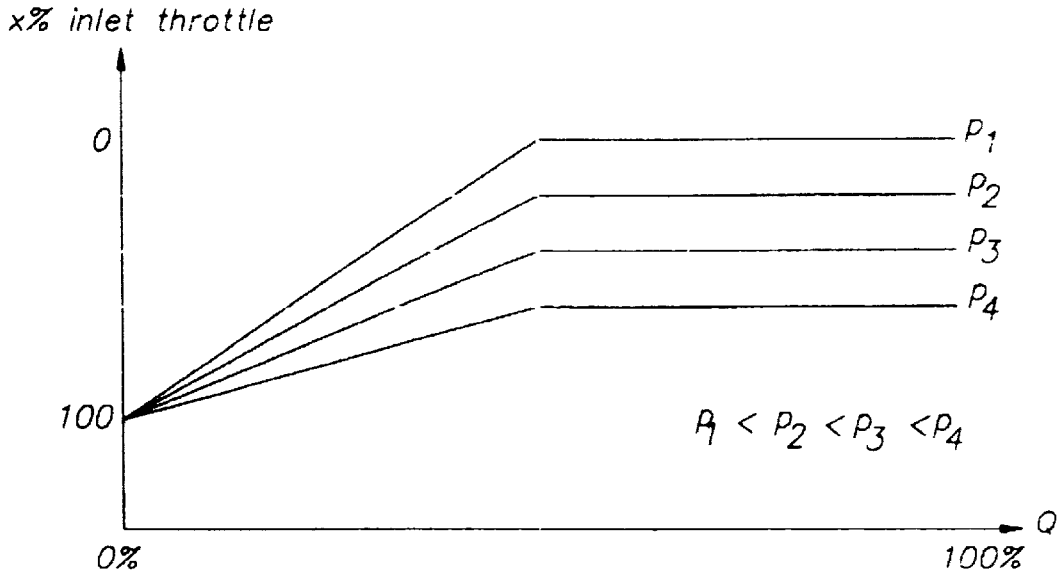
FIG. 3 shows various curves representing the degree of throttling of the inlet at various operating pressures p.

This is shown schematically in FIG. 3: the higher the operating pressure p, the higher the specific percentagexgreater than zero by which the inlet 3 is at least throttled by the means 6.

The curves indicate for different operating pressures p to what extent the inlet 3 is throttled as a function of the flow rate Q. As shown in this figure, in which the operating pressure $p_1$ is equal to $p_{w,max}$, when operating pressures are higher than $p_1$, the inlet will be throttled for at least a specific percentagexgreater than zero. At an operating pressure $p_1=p_{w,max}$, the inlet will not be throttled for at least a specific percentagexgreater than zero. Only when the demanded flow rate Q drops too far, the inlet 3 will be throttled.

By throttling the means 6 more when the operating pressure p is higher, the flow rate supplied will decrease more, as a result of which the compressor element 2 will draw less power from the drive 8. Moreover, more engine power will be available, because the rotational speed s of the drive 8 is not reduced. As a result, it will be possible to reach a higher measured operating pressure.

When high operating pressures are demanded of the compressor system 1, the method according to the invention therefore consist of throttling the inlet 3 for at least a specific percentagexgreater than zero in order for the higher operating pressure to be realized, and subsequently applying the principle of the known method, i.e. if the rotational speed s of the drive 8 is variable, first reducing the rotational speed s of the drive 8 in case of a reduced demanded flow rate Q and only then throttling the inlet 3 further. Even though this involves a small loss of efficiency, this will make it possible to achieve these higher operating pressures.

With lower operating pressures p, the method according to the invention will apply the known traditional control method, so that the efficiency of the compressor system 1 is optimal.

Additionally, but not necessary according to the invention, the following control method is applied as long as the demanded flow rate Q increases:

- as long as the operating pressure p is equal to or lower than the aforementioned maximum obtainable operating pressure $p_{w,max}$, to apply the following control method:
  - as long as the demanded flow rate Q increases, first, the throttling is reduced in order to set the measured operating pressure $p_w$ to the desired operating pressure $p_{set}$, until the inlet 3 is entirely open or free again;
  - when the inlet 3 is entirely open or free again and as long as the demanded flow rate Q increases even further, if possible, the rotational speed s of the drive 8 is increased in order to set the measured operating pressure $p_w$ to the desired operating pressure $p_{set}$;
- as long as the operating pressure p is higher than the aforementioned maximum obtainable operating pressure $p_{w,max}$, to apply the following control method:
  - the inlet 3 is throttled for at least a specific percentagexgreater than zero;
  - as long as the demanded flow rate Q increases, first, the throttling of the inlet 3 is reduced in order to set the measured operating pressure $p_w$ to the desired operating pressure $p_{set}$, until the inlet 3 is throttled for the aforementioned specific percentagexgreater than zero;

when the inlet 3 is throttled for the aforementioned specific percentagexgreater than zero and as long as the demanded flow rate Q increases even further, if possible, the rotational speed s of the drive 8 is increased in order to set the measured operating pressure $p_w$ to the desired operating pressure $p_{set}$.

This means, in fact, that the steps are effectively taken in the opposite order as compared to the situation in which the demanded flow rate Q drops.

For operating pressures p that are equal to or lower than $p_{w,max}$ as well for operating pressures p that are higher than $p_{w,max}$, in case of an increase of the demanded flow rate Q, first, the throttling of the inlet 3 will be reduced in order to set the measured operating pressure $p_w$ to the desired operating pressure $p_{set}$ before, if possible and if necessary, increasing the rotational speed s of the drive 8 in order to comply with the increased demanded flow rate Q, the difference being that as long as the operating pressure p is equal to or lower than $p_{w,max}$, the inlet 3 is first fully opened before the rotational speed s of the drive 8 is increased, if that is possible, whereas as long as the operating pressure p is higher than $p_{w,max}$, the inlet 3 remains throttled for at least a specific percentagexgreater than zero. This implies that in order to reach an operating pressure p that is higher than the aforementioned maximum obtainable operating pressure $p_{w,max}$, if the rotational speed of the drive is variable, the rotational speed s of the drive 8 will be increased earlier.

The present invention is in no way limited to the embodiments described as example and shown in the figures, however, such method and compressor system may be embodied in different variations without falling outside the scope of the invention.

The invention claimed is:

1. A method for actuating a compressor system that supplies compressed gas to a user network at a flow rate demanded by the user network, at a desired operating pressure ($p_{set}$), wherein the compressor system comprises a compressor element with an inlet and an outlet, wherein the compressor element is driven by a drive, and wherein the compressor system is provided with a means for throttling the inlet, the method comprising the step of:

after initially throttling the inlet, further throttling the inlet as long as the desired operating pressure ($p_{set}$) or a measured operating pressure ($p_w$) is higher than a maximum obtainable operating pressure ($p_{w,max}$), wherein the maximum obtainable operating pressure ($p_{w,max}$) is a maximum operating pressure that the compressor system can supply to the user network when the inlet is not throttled;

wherein as long as the desired operating pressure ($p_{set}$) or the measured operating pressure ($p_w$) is higher than the maximum obtainable operating pressure ($p_{w,max}$) and as long as the demanded flow rate is increasing, the throttling is reduced until the inlet is throttled to, and no further than, a specific percentage (x) greater than zero.

2. The method according to claim 1, wherein the specific percentage (x) to which the inlet of the compressor element is throttled is based on a difference between the desired operating pressure ($p_{set}$) or the measured operating pressure ($p_w$) and the maximum obtainable operating pressure ($p_{w,max}$).

3. The method according to claim 2, wherein the specific percentage (x) to which the inlet of the compressor element is throttled increases proportionally by the difference between the desired operating pressure ($p_{set}$) or the measured operating pressure ($p_w$) and the maximum obtainable operating pressure ($p_{w,max}$).

4. The method according to claim 1, wherein the throttling of the inlet of the compressor element is accomplished by providing the means with an inlet throttling valve and by controlling the inlet throttling valve.

5. The method according to claim 1, wherein as long as the demanded flow rate drops, the inlet is further throttled by the means.

6. The method according to claim 1, wherein a rotational speed of the drive is controlled.

7. The method according to claim 6, wherein the method comprises the following steps:

as long as the demanded flow rate drops, first reducing the rotational speed of the drive until a minimum rotational speed ($s_{min}$) of the drive is reached; and when the minimal rotational speed ($s_{min}$) of the drive is reached and as long as the demanded flow rate drops even further, further throttling the inlet by way of the means.

8. The method according to claim 6, wherein as long as the operating pressure (p) is equal to or lower than the maximum obtainable operating pressure ($p_{w,max}$) for the compressor system, the method further consists of the following:

as long as the demanded flow rate increases, first reducing the throttling by way of the means until the inlet is entirely open; and when the inlet is entirely open and as long as the demanded flow rate increases even further, increasing the rotational speed of the drive.

9. A compressor system comprising a compressor element with an inlet and an outlet, the compressor element driven by a drive, wherein the compressor system is provided with a control unit that is capable of throttling the inlet of the compressor element, wherein the rotational speed of the drive is controlled by the control unit, wherein the control unit is configured to execute the method according to claim 6.

10. A compressor system, comprising a compressor element with an inlet and an outlet, wherein the compressor system is provided with a control unit that is capable of throttling the inlet of the compressor element, and wherein the control unit is configured to execute the method according to claim 1.

11. The compressor system according to claim 10, wherein the means for throttling the inlet of the compressor element comprise an inlet throttling valve.

12. The compressor system according to claim 10, wherein the compressor system is an oil-injected screw compressor system.

13. The compressor system according to claim 10, wherein the compressor system is a mobile compressor system.

14. A method for actuating a compressor system that supplies compressed gas to a user network at a flow rate demanded by the user network, at a desired operating pressure ($p_{set}$), wherein the compressor system comprises a compressor element with an inlet and an outlet, wherein the compressor element is driven by a drive, and wherein the compressor system is provided with a means for throttling the inlet, the method comprising the step of:

after initially throttling the inlet, further throttling the inlet by way of the means as long as the desired operating pressure ($p_{set}$) or a measured operating pressure ($p_w$) is higher than the maximum obtainable operating pressure ($p_{w,max}$), wherein the maximum obtainable operating pressure ($p_{w,max}$) is a maximum operating pressure that the compressor system can supply to the user network when the inlet is not throttled, and wherein a rotational speed of the drive is controlled, wherein as long as the desired operating pressure ($p_{set}$) or the measured operating pressure ($p_w$) is higher than the maximum obtainable operating pressure ($p_{w,max}$) for the compressor system, the method further consists of the following:

as long as the demanded flow rate increases, first reducing the throttling by way of the means until the inlet is throttled by the means to a specific percentage (x) greater than zero; and when the inlet is throttled to the specific percentage (x) and as long as the demanded flow rate increases even further, increasing the rotational speed of the drive.

* * * * *